United States Patent [19]

Duhl et al.

[11] Patent Number: 4,492,672

[45] Date of Patent: Jan. 8, 1985

[54] ENHANCED MICROSTRUCTURAL STABILITY OF NICKEL ALLOYS

[75] Inventors: David N. Duhl, Newington, Conn.; Xuan Nguyen-Dinh, Phoenix, Ariz.

[73] Assignee: The United States of America as represented by the Secretary of the Navy, Washington, D.C.

[21] Appl. No.: 369,880

[22] Filed: Apr. 19, 1982

[51] Int. Cl.[3] ..... C22C 19/05

[52] U.S. Cl. ..... 420/448

[58] Field of Search ..... 420/448; 148/410, 428

[56] References Cited

U.S. PATENT DOCUMENTS

| | | | |
|---|---|---|---|
| 2,570,193 | 10/1951 | Bieber et al. | 75/171 |
| 2,948,606 | 8/1960 | Thielemann | 75/171 |
| 3,310,399 | 3/1967 | Baldwin | 75/171 |
| 3,310,440 | 3/1967 | Piearcey | 148/13 |
| 3,403,059 | 9/1968 | Barker | 148/32.5 |
| 3,411,899 | 11/1968 | Richards et al. | 75/171 |
| 3,459,545 | 8/1969 | Bieber et al. | 75/171 |
| 3,510,294 | 5/1970 | Bieber et al. | 75/171 |
| 3,519,419 | 7/1970 | Gibson et al. | 75/171 |
| 3,526,499 | 9/1970 | Quigg et al. | 75/171 |
| 3,591,372 | 7/1971 | Hockin et al. | 75/171 |
| 3,617,261 | 11/1971 | Lherbier et al. | 75/171 |
| 3,617,262 | 11/1971 | Shaw et al. | 75/171 |
| 3,677,835 | 7/1972 | Tien et al. | 148/32.5 |
| 3,807,993 | 4/1974 | Dalai et al. | 75/171 |
| 3,902,862 | 9/1975 | Moll et al. | 29/182 |
| 3,902,900 | 9/1975 | Restall et al. | 75/171 |
| 4,039,330 | 8/1977 | Shaw | 75/171 |
| 4,169,726 | 10/1979 | Fairbanks | 75/134 |
| 4,207,098 | 6/1980 | Shaw | 75/171 |
| 4,209,348 | 6/1980 | Duhl et al. | 148/3 |

*Primary Examiner*—R. Dean

*Attorney, Agent, or Firm*—Robert F. Beers; Frederick A. Wein

[57] ABSTRACT

The microstructural stability of nickel base alloys at high temperatures is enhanced by the addition of cobalt within the range of 10.0 to 14.9 weight percent for reducing the precipitation of the sigma phase in alloys with more than 12 weight percent chromium. The nickel-base alloys having cobalt addition in the range as set forth are characterized by an electron vacancy number within the range of 2.4 to 2.7 inclusive.

1 Claim, 5 Drawing Figures

14.9w/o Co 10.2w/o Co

Figure 3 - Effect of Cobalt Additions on the Precipitation of Sigma Phase in Alloy I-20.

ENHANCED MICROSTRUCTURAL STABILITY OF NICKEL ALLOYS

BACKGROUND OF THE INVENTION

The microstructural stability of high temperature alloys is important in that precipitation of extraneous phases such as the topologically close packed phases sigma, mu, etc. or laves phase from an unstable alloy matrix is undesirable inasmuch as the extraneous precipitated phase can decrease strength, ductibility, fatigue resistance and impact resistance. Microstructural stability is usually measured by exposing an alloy to an elevated temperature for an extended period of time such as 1,000 hours, and metallographically examining the exposed sample for the presence of any extraneous phases. Alloy stability is usually correlated with electron vacancy number $N_v$, and it is usually considered by those skilled in the art that the alloy is unstable when the electron vacancy number exceeds a critical value.

Accordingly, it is desirable to reduce the precipitation of extraneous phases, and in particular, the sigma phase for enhancement of microstructural stability of high temperature nickel-base alloys.

SUMMARY OF THE INVENTION

Briefly, the microstructural stability of nickel-base alloys at high temperatures is enhanced by the addition of cobalt within the range of 10.0 to 14.9 weight percent for reducing the precipitation of the sigma phase in nickel-base alloys with 12 to 24 weight percent chromium. The nickel-base alloys having cobalt additions in the range as set forth are characterized by an electron vacancy number within the range of 2.4 to 2.7 inclusive.

OBJECTS OF THE INVENTION

Accordingly, it is an object of the present invention to enhance the microstructural stability at high temperatures (1600°–1800° F.) of nickel-base alloys by addition of cobalt within specified weight percent ranges. A further object of the present invention is to enhance the microstructural stability of nickel-base alloys at high temperatures by elimination of any sigma phase precipitation.

Further objects and advantages of the present invention will become apparent as the following description proceeds and the features of novelty characterizing the invention will be pointed out with particularity in the claims annexed to and forming a part of this specification.

DESCRIPTION OF THE DRAWINGS

For a better understanding of the present invention reference may be had to the accompanying drawings wherein.

DETAILED DESCRIPTION OF THE PREFERRED EMBODIMENT

Figure 1A:
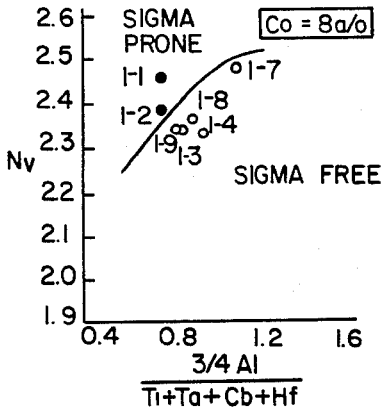
FIGS. 1*a, b* and *c* are graphs showing the correlation between $N_v$ and plate ratio on sigma phase precipitation in nickel-base alloys for various cobalt levels.

It has been found, contrary to the teachings of the prior art, that the addition of cobalt which increases $N_v$ for certain nickel-base alloys is beneficial in enhancing the microstructural stability of nickel-base alloys with chromium contents in excess of 12 weight percent. Referring now to FIGS. 1*a, b,* and *c* are shown graphs of alloy stability related to composition by plotting $N_v$ versus the plate ratio, $(\frac{3}{4})(Al)/(Ti+Ta+Cb+Hf)$ in atomic percent for respective concentrations of cobalt of 8, 10, and 14.5 atomic percent. These graphs show sigma free (stable) and sigma prone (unstable) regions. Each cobalt level is shown for obtaining an accurate correlation.

From FIG. 1, it can be seen that cobalt and the plate ratio effect sigma phase precipitation even at values of $N_v$ lower than the commonly adopted critical $N_v$ value of 2.5 at which sigma phase precipitation is usually thought to occur (alloys I-1 and I-2 in FIG. 1*a*).

The steps for calculation of the electron vacancy number ($N_v$) are as follows:

1. Convert the composition from weight percent to atomic percent.

2. After long time exposure in the sigma forming temperature range the MC carbides tend to transform to $M_{23}C_6$.

(a) Assume one-half of the carbon forms MC in the following preferential order: TaC, NbC, TiC.

(b) Assume the remaining carbon forms $M_{23}C_6$ of the following composition: $Cr_{21}(Mo,W)_2C_6$ or $Cr_{23}C_6$ in the absence of molybdenum or tungsten.

3. Assume boron forms $M_3B_2$ of the following composition: $(Mo_{0.5}Ti_{0.15}Cr_{0.25}Ni_{0.10})_3B_2$.

4. Assume gamma prime to be of the following composition: $Ni_3(Al,Ti,Ta,Nb,Zr,0.03Cr)$.

5. The residual matrix will consist of the atomic percent minus those atoms tied up in the carbide reaction, boride reaction, and the gamma prime reaction. The total of these remaining atomic percentages gives the atomic conentration in the matrix. Conversion of this on the 100% basis gives the atomic percent of each element remaining in the matrix. It is this percentage that is used in order to calculate the electron vacancy number.

6. The formula for calculation of the electron vacancy number is as follows: $N_v=0.66Ni+1.71Co+2.66Fe+3.66Mn+4.66(Cr+Mo+W)+5.66V+6.66Si$.

Figure 1B:
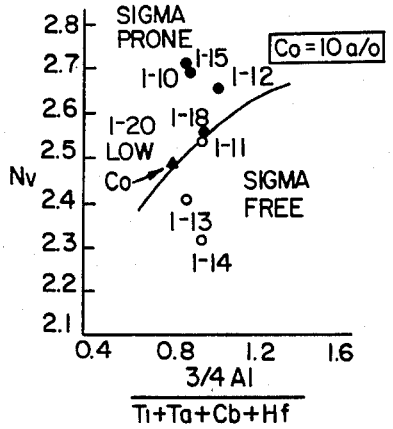
Figure 1C:
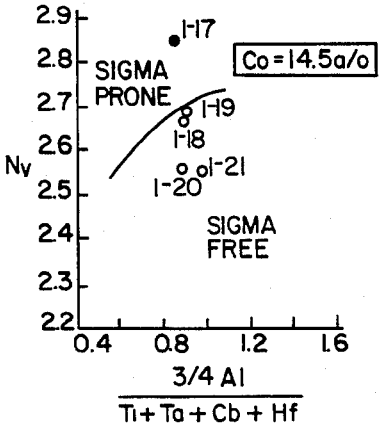
Figure 2:
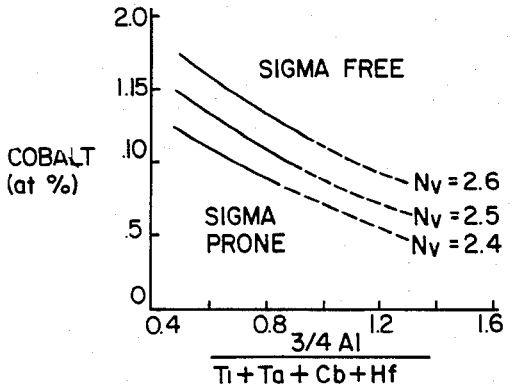
FIG. 2 is a graph showing the effect of cobalt on the critical $N_v$ required for sigma phase precipitation in nickel-base alloys.

The effect of cobalt in increasing the critical $N_v$ can be seen by comparing the location of the line defining the critical $N_v$ in FIG. 1*a* for eight atomic percent cobalt with the location of the line defining the critical $N_v$ in FIG. 1*b* for 10 atomic percent cobalt and with FIG. 1*c* for 14.5 atomic percent cobalt. It is seen that the critical $N_v$ increases with increasing cobalt for a fixed value of the plate ratio. Another way of showing this is the plot shown in FIG. 2, where for a given plate ratio the critical $N_v$ is shown to increase with increasing cobalt content. The alloys utilized to define the critical $N_v$ curves defined in FIG. 1 are listed in Table I below.

TABLE I

CHEMICAL COMPOSITIONS OF NICKEL-BASE ALLOYS (Weight Percent)

| Alloy | Cr | W | Ta | Al | Ti | Co | Others | Ni |
|---|---|---|---|---|---|---|---|---|
| I-1 | 11.7 | 3.9 | 9.9 | 3.4 | 3.5 | 7.9 | — | Balance |
| I-2 | 11.9 | 3.9 | 7.9 | 3.4 | 4.0 | 7.8 | — | Balance |
| I-3 | 11.8 | 5.9 | 5.9 | 3.5 | 3.9 | 7.8 | — | Balance |
| I-4 | 11.9 | 7.9 | 4.0 | 3.5 | 4.9 | 8.0 | — | Balance |
| I-5 | 12.0 | 3.8 | 8.1 | 4.2 | 2.9 | 8.0 | — | Balance |
| I-6 | 12.2 | 3.8 | 6.2 | 3.4 | 3.7 | 7.9 | — | Balance |
| I-7 | 11.8 | 3.8 | 5.9 | 3.5 | 3.9 | 8.1 | 4.9 Fe | Balance |
| I-8 | 11.9 | 4.0 | 6.2 | 3.5 | 3.8 | 8.0 | 0.48 Si | Balance |
| I-9 | 12.2 | 3.9 | 6.1 | 3.5 | 4.0 | 8.0 | 0.58 Mn | Balance |

TABLE I-continued

CHEMICAL COMPOSITIONS OF NICKEL-BASE ALLOYS (Weight Percent)

| Alloy | Cr | W | Ta | Al | Ti | Co | Others | Ni |
|---|---|---|---|---|---|---|---|---|
| I-10 | 15.2 | 3.9 | 5.9 | 3.6 | 3.9 | 10.0 | — | Balance |
| I-11 | 15.2 | 3.8 | 5.9 | 3.5 | 3.4 | 10.0 | — | Balance |
| I-12 | 14.9 | 6.2 | 5.9 | 3.6 | 3.3 | 9.9 | — | Balance |
| I-13 | 15.2 | 3.8 | 6.0 | 3.2 | 3.3 | 10.0 | — | Balance |
| I-14 | 15.9 | 3.7 | 4.2 | 3.1 | 3.3 | 10.0 | — | Balance |
| I-15 | 18.2 | 3.9 | 5.8 | 3.2 | 3.4 | 10.0 | — | Balance |
| I-16 | 17.5 | 5.7 | 4.0 | 3.1 | 3.3 | 10.1 | — | Balance |
| I-17 | 18.5 | 4.1 | 6.1 | 3.1 | 3.3 | 14.8 | — | Balance |
| I-18 | 21.3 | 2.9 | 3.9 | 3.7 | 3.0 | 14.8 | — | Balance |
| I-19 | 21.2 | 2.94 | 6.1 | 3.66 | 2.33 | 14.9 | — | Balance |
| I-20 | 23.6 | 3.1 | 3.9 | 2.12 | 2.10 | 14.9 | — | Balance |
| I-21 | 23.9 | 3.0 | 3.1 | 2.17 | 2.20 | 14.9 | — | Balance |

Figure 3:
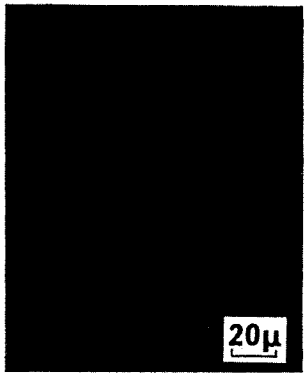
FIG. 3 shows the effect of cobalt additions on the microstructural stability of alloy I-20.
Figure 3:
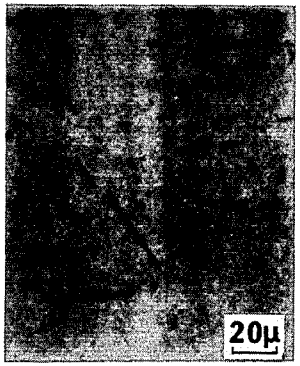

An example of the effect of cobalt on microstructural stability can be seen in FIGS. 1*b, c* and 3. Alloy I-20 which has 14.9 weight percent cobalt is stable as shown in FIGS. 1*c* and 3. When the same alloy is evaluated with only 10.2 weight percent cobalt, with the 4.7 weight percent cobalt being replaced with nickel, it is microstructurally unstable as shown in FIGS. 1*b* and 3.

Thus there is disclosed an enhancement of microstructural stability of nickel-based alloys at high temperatures by the addition of cobalt within the range of 10.0 to 14.9 atomic percent for reduction of the precipitation of the sigma phase. The addition of cobalt within the specified ranges set forth is characterized by an electron vacancy number within the range of numeral 2.4 to numeral 2.7 inclusive.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. A method of enhancing the microstructural stability at high temperatures of nickel-base alloys having ingredients consisting essentially in weight percentage ranges set forth: chromium 12.0–24.0, tungsten 2.9 to 4.9, tantalum 3.1 to 9.9, aluminum 2.1 to 4.2, titanium 2.6 to 4.9, the improvement being characterized by the addition of cobalt within the range of 10.0 to 14.9 weight percent for bringing the electron vacancy number of the alloy within the range of 2.4 to 2.7 inclusive for reduction of precipitation of the sigma phase, the remainder being nickel.

* * * * *